US008763709B2

(12) United States Patent
Shampine

(10) Patent No.: US 8,763,709 B2
(45) Date of Patent: Jul. 1, 2014

(54) ELECTRICALLY DRIVEN COILED TUBING INJECTOR ASSEMBLY

(75) Inventor: Rod Shampine, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 436 days.

(21) Appl. No.: 12/900,050

(22) Filed: Oct. 7, 2010

(65) Prior Publication Data

US 2012/0085553 A1 Apr. 12, 2012

(51) Int. Cl.
*E21B 19/08* (2006.01)
*E21B 19/22* (2006.01)

(52) U.S. Cl.
USPC ..... 166/384; 166/77.3

(58) Field of Classification Search
USPC ..... 166/384, 381, 66.4, 77.2, 77.3; 318/34, 318/67, 68, 69, 77, 76, 45–48, 112
See application file for complete search history.

(56) References Cited

U.S. PATENT DOCUMENTS

| | | | | |
|---|---|---|---|---|
| 1,388,555 | A * | 8/1921 | Eades | 318/34 |
| 1,667,718 | A * | 5/1928 | Connell | 318/8 |
| 1,731,879 | A * | 10/1929 | Thompson | 212/235 |
| 1,744,455 | A * | 1/1930 | Duwe | 405/89 |
| 1,832,634 | A * | 11/1931 | Hild | 173/5 |
| 2,436,936 | A * | 3/1948 | Page | 318/8 |
| 2,735,059 | A * | 2/1956 | Schaelchlin | 318/76 |
| 4,172,391 | A * | 10/1979 | Dressel | 173/21 |
| 4,431,063 | A * | 2/1984 | Dressel et al. | 173/149 |
| 6,047,784 | A | 4/2000 | Dorel | |
| 6,116,345 | A | 9/2000 | Fontana et al. | |
| 6,419,014 | B1 | 7/2002 | Meek et al. | |
| 6,516,892 | B2 * | 2/2003 | Reilly | 166/384 |
| 6,712,159 | B2 | 3/2004 | Estes et al. | |
| 6,923,273 | B2 | 8/2005 | Terry et al. | |
| 7,431,092 | B2 | 10/2008 | Haheim et al. | |
| 7,494,438 | B2 * | 2/2009 | Kimura et al. | 475/150 |
| 7,556,105 | B2 | 7/2009 | Krueger | |
| 7,640,999 | B2 | 1/2010 | Patton | |
| 7,804,060 | B2 | 9/2010 | Guo et al. | |
| 8,544,536 | B2 * | 10/2013 | McCulloch et al. | 166/77.3 |
| 2002/0195255 | A1 * | 12/2002 | Reilly | 166/384 |
| 2002/0195978 | A1 * | 12/2002 | Oyori | 318/34 |
| 2005/0224224 | A1 * | 10/2005 | Martin et al. | 166/77.3 |
| 2006/0231267 | A1 * | 10/2006 | Wood | 166/379 |
| 2006/0237234 | A1 | 10/2006 | Dennis et al. | |

(Continued)

OTHER PUBLICATIONS

International Preliminary Report on Patentability for International Application No. PCT/US2011/055199 dated Apr. 18, 2013.

(Continued)

*Primary Examiner* — Blake Michener
(74) *Attorney, Agent, or Firm* — Michael Flynn; Tim Curington; Robin Nava

(57) ABSTRACT

An assembly and techniques for employing multiple motors to drive an oilfield injector. The injector is configured to drive a well access line such as coiled tubing and the motors may be electric in nature. Additionally, the motors are configured to operate at substantially sufficient cooling speeds for electric motors. Nevertheless, the motors are coupled through a common differential mechanism such that a range of differential speeds may be derived via comparison of the operating speeds of the motors. Thus, a wide array of injection speeds may be employed without requiring the motors to operate at dangerously low speeds in terms of electric motor cooling.

20 Claims, 6 Drawing Sheets

(56) References Cited

U.S. PATENT DOCUMENTS

| | | | | |
|---|---|---|---|---|
| 2009/0235656 | A1 | 9/2009 | Havinga | |
| 2009/0250205 | A1 * | 10/2009 | Koopmans et al. | 166/66.4 |
| 2012/0073833 | A1 * | 3/2012 | McCulloch et al. | 166/384 |

OTHER PUBLICATIONS

Anonymous, "F200K A/C Injector," Foremost Industries LP Brochure, retrieved May 4, 2009: pp. 1-2, <www.foremost.ca>.

* cited by examiner

ELECTRICALLY DRIVEN COILED TUBING INJECTOR ASSEMBLY

FIELD

Embodiments described relate to coiled tubing injectors. In particular, embodiments of coiled tubing injectors which are electrically driven are described in detail. Assemblies which employ such electrical power at the oilfield may be particularly beneficial in terms of reducing the footprint and providing improved safety.

BACKGROUND

While a hydrocarbon well is often no more than a foot in diameter, overall operations at an oilfield may be quite massive. The amount of manpower, expense, and equipment involved may be daunting when considering all that is involved in drilling, completing and managing a productive well. Indeed, for ease of management, the amount of footspace available and the desire to keep separate equipment in close proximity to one another may also be significant issues. This may be particularly true in the case of offshore operations, with footspace limited to a discernable platform.

Along these lines, in the area of coiled tubing assemblies, efforts have been made to minimize footspace requirements and provide a less cumbersome equipment set-up. For example, a conventional coiled tubing assembly includes an injector for driving up to several thousand feet of pipe from a reel and into a well at rates of between about an inch a minute to about 150 feet per minute. In addition to extensive depth, the coiled tubing may be driven through challenging well architecture such as highly deviated sections. Thus, power is generally obtained from a large diesel engine which powers a hydraulic pump that in turn drives the coiled tubing injector. This conventional set-up requires a large amount of footspace in addition to presenting management issues in terms of the presence of hydraulic oil and large, relatively stiff hoses. Indeed, mismanagement of the oil or failure of a hose may lead to failure of the entire assembly. Further, ensuring that the equipment is safely explosion-proofed presents its own set of challenges, particularly as emissions reduction requirements for the engine become more strict over time.

As indicated above, in light of the drawbacks to the conventional coiled tubing assembly set-up, efforts have been made to avoid use of the diesel engine or other hydraulic motors as a power source. For example, it has been proposed that the diesel engine be replaced with a 200 kW or so electric motor. This would eliminate the presence of hydraulic oil and hoses along with the failure modes associated with such aspects of internal combustion engines. Indeed, explosion proofing of an electric power source would be inherently improved over that of a diesel engine. Additionally, assuming the power supply is sufficient, use of a hydraulic pump may be eliminated and the amount of footspace required would be dramatically reduced.

Unfortunately, while well suited for operating at high rpm and power output, due to internal cooling limitations, an electric motor is not configured for operating at speeds that are dramatically variable. That is, as noted above, coiled tubing advancement may take place over a range of different speeds, from 150 feet per minute down to an inch a minute, for example. However, as the electric motor slows from directing a rate of 150 feet per minute to only an inch a minute, the cooling capacity of the motor also reduces. This is because the cooling system of an electric motor is tied to the rpm of the motor. Thus, even though speed is slowed, the current utilized is increased so as to ensure sufficient torque is employed throughout the operation. Therefore, the reduction in cooling capacity may lead to failure of the motor.

Efforts may be taken in order to address cooling issues with the electric motor when operating at a high torque/low speed ratio as noted above. For example, as opposed to relying solely on an internal cooling mechanism tied to motor rpm, liquid coolant may be introduced within the motor. However, this presents much of the same drawbacks as are found with hydraulic oil as described above. Furthermore, in the case of an electric motor which is configured to operate substantially friction free, the coolant introduces the inefficiency of a significant amount of drag.

Alternatively, electric motor cooling issues may be addressed by the introduction of added external cooling devices which may be coupled to the motor. However, this adds to the overall equipment size and footprint. Additionally, in order to ensure adequate safety and explosion proofing, an added level of complexity is introduced by the incorporation of flame traps between the external cooling devices and the motor. Thus, on the whole, options are available to help address heating issues of electric motors operating at variable and lower speeds. However, as such measures are undertaken, much of the potential benefit of employing an electric motor becomes lost. Indeed, as a practical matter, coiled tubing assemblies remain almost exclusively powered by diesel engines in spite of the smaller footprint and management advantages that are generally available from electric motors.

SUMMARY

A coiled tubing injector assembly is provided which may include multiple motors. In one embodiment a first motor is configured to operate at a given speed, whereas a second motor is configured to operate at a different speed. Thus, a differential mechanism coupled to the motors may be configured to establish a differential speed based at least in part on the given and different speeds. As such, a coiled tubing injector that is also coupled to the differential mechanism may operate at an injector speed that is based on the differential speed. Furthermore, the motors may be electric motors.

A method of operating the assembly may include employing the differential mechanism to translate a function of the motor speeds toward the injector. In this case, the differential speed may be based on a predetermined linear function of the operating speeds of the motors compared against one another.

DETAILED DESCRIPTION

Embodiments herein are described with reference to specific multi-motor electrically driven assemblies. For example, embodiments herein depict assemblies employed utilizing two or three motors in driving coiled tubing cleanout applications. However, a variety of alternative applications may make use of the embodiments described herein. Additionally, any practical number of motors in excess may be employed. Regardless, embodiments described herein take advantage of multiple motors each operating at its own independently determined speed. Thus, an intervening differential mechanism may be employed to direct the operational speed of the application device (e.g. a coiled tubing injector).

Figure 1A:
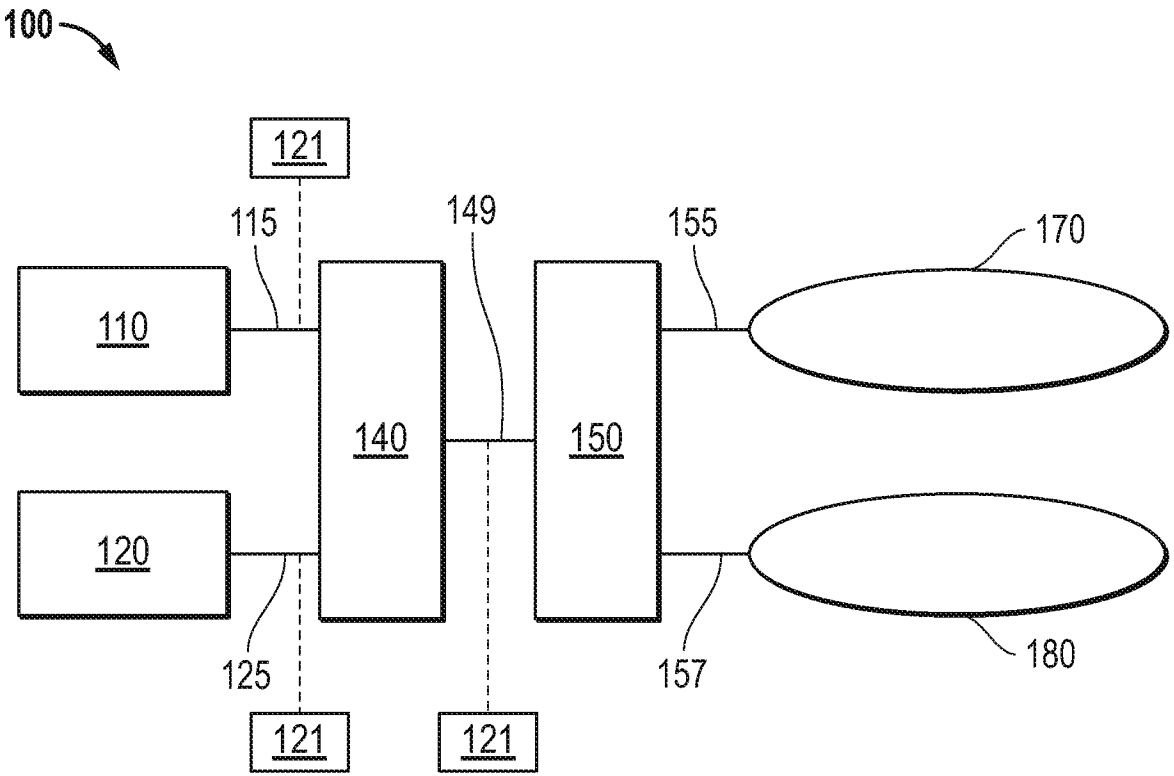
FIG. 1A is a schematic representation of an embodiment of a multi-motor electrically driven coiled tubing assembly.

Referring now to FIG. 1A, a schematic representation of an embodiment of a multi-motor electrically driven coiled tubing assembly 100 is shown. The assembly 100 includes first 110 and second 120 electric motors each configured to independently operate at speeds sufficient to ensure adequate cooling is maintained for each. For example, in an embodiment where each motor 110, 120 is of a conventional 60 Hz variety, it may be important, when in use, to operate the motors 110, 120 at speeds in excess of about 750 rpm, preferably at over 1,000 rpm to ensure adequate cooling. Indeed, embodiments detailed herein may operate at motor speeds of between 20% and 200% of their design capacity, but through techniques detailed below may more preferably and reliably operate at between about 80% and 120% of their design capacity.

Figure 2:
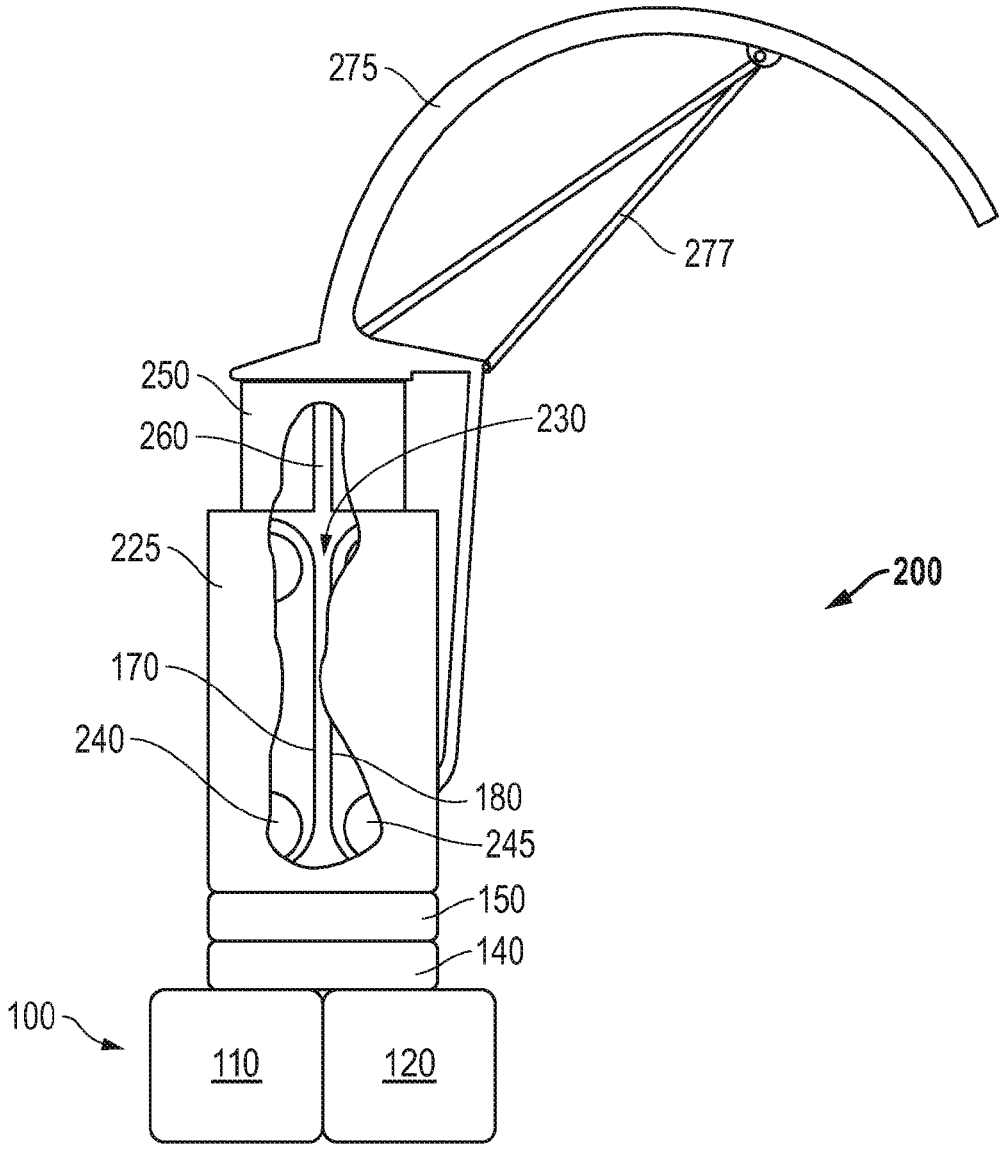
FIG. 2 is a side partially sectional view of an embodiment of a coiled tubing injector employing the multi-motor assembly of FIG. 1A.

With added reference to FIG. 2, given that a range of speeds may be sought for driving a coiled tubing injector 200, a differential gear box 140 is also provided. That is, each motor 110, 120 may be linked to the differential gear box 140 through appropriate first 115 and second 125 linkages. Thus, rather than a straight line transfer of rpm from the motors 110, 120 to the injector 200, the gear box 140 may serve as a mechanism for determining how speed is acquired from the motors 110, 120. In other words, the differential gear box 140 may be used to establish a relationship between the motors 110, 120 which determines a differential speed acquired therefrom. For example, in one embodiment the acquired differential speed is the speed of the first motor 110 less that of the second motor 120. Thus, where the first motor 110 is operating at 1,500 rpm and the second 120 at 1,000 rpm, the differential speed would be 500 rpm.

In the embodiment described above, a differential speed of 500 rpm is attained which may be translated on toward the injector 200 as described further below. It is worth noting at this point, however, that an otherwise unsafe speed of 500 rpm, in terms of motor cooling, is now available to the assembly 100 without requiring that either motor 110, 120 operate at such an unsafe speed. That is, both motors 110, 120 operate at or above 1,000 rpm to ensure sufficient electrical motor cooling is maintained.

Furthermore, by utilizing the differential gear box 140 to govern a comparative relationship between motor speeds, an entire range of differential speeds may be established. In an extreme example, where the differential speed is acquired by the speed of the first motor 110 less that of the second 120, the first speed may be 1,001 rpm and the second 1,000 rpm, providing a differential speed of a single rpm without sacrifice to any cooling capability of the motors 110, 120. By the same token, the first speed may be 1,999 rpm and the second 1,000 rpm, resulting in a 999 rpm differential speed. Of course, with 1,000 rpm being a safe cooling speed in the example scenario, the first motor 110 may be operated at 1,000 rpm and the second motor 120 turned off to provide a differential speed of 1,000 rpm.

It is also worth noting that in certain circumstances the speed of the first motor 110 may be less than the speed of the second 120. Thus, in a scenario where the second 120 is operating at 1,500 rpm and the first 110 at 1,000 rpm, a −500 rpm value may more appropriately be thought of as 500 rpm in the opposite direction. So, where 500 rpm is utilized to power the injector 200 to drive coiled tubing 310 into a well 385 of FIG. 3, −500 rpm (or 500 rpm in the opposite direction) may be utilized to power the injector 200 to withdraw the tubing 310.

The comparative relationship between the motor speeds as governed through the differential gear box 140 may take a variety of forms. That is, as a practical matter and for ease of explanation, it may be preferable that the differential speed be the speed of the first motor 110 less that of the second 120. However, the gear box 140 may be configured to provide a differential speed that is the speed of the first motor 110 less ¾, ½, or any other percentage of the second. Indeed, a host of different conventional gear-based ratios or parameters may be utilized in governing the relationship between the motor speeds so as to provide the differential speed. In fact, as detailed further below with respect to FIG. 4A, such gear-based parameter options and complexity may be expanded by the inclusion of additional motors (see the third motor 490).

Figure 1B:
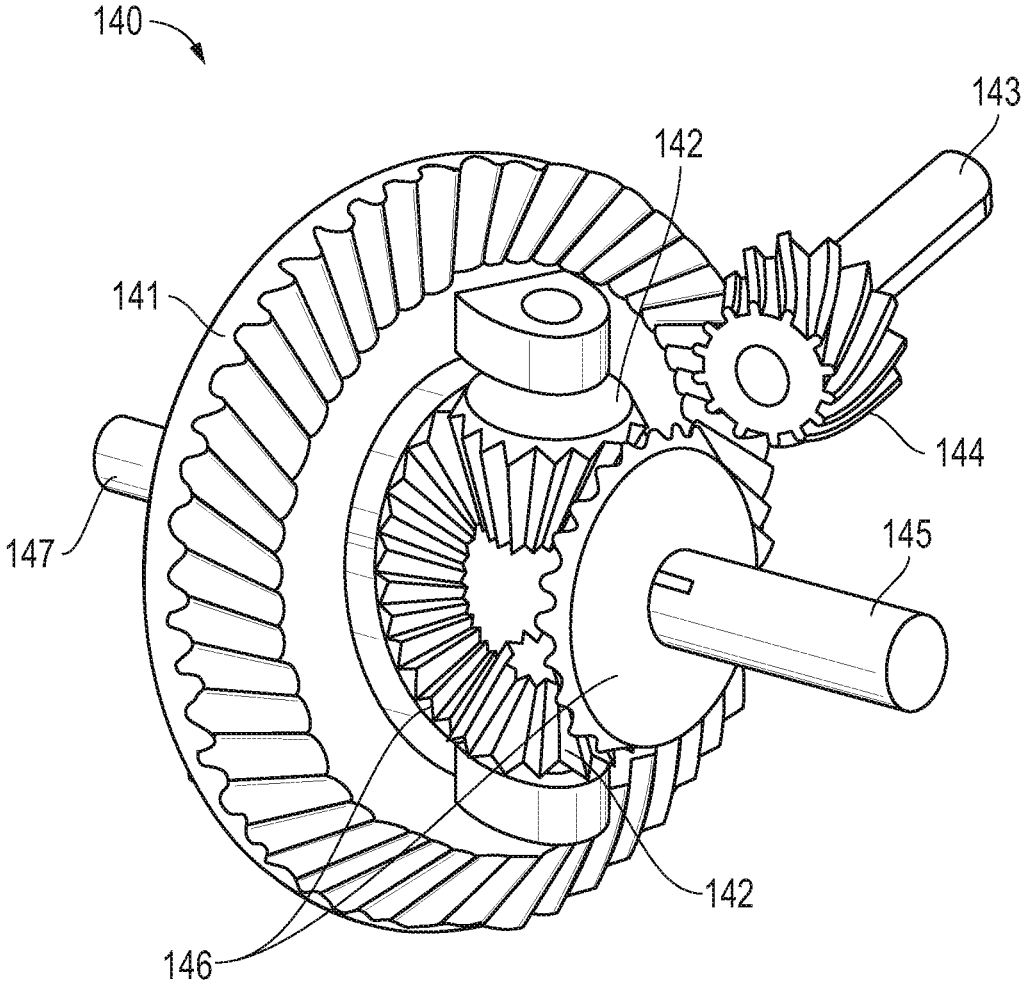
FIG. 1B is a perspective view of an embodiment of a gear box of the multi-motor assembly.

With brief reference to FIG. 1B, an embodiment of the internal mechanics of the gear box 140 is depicted. In this embodiment, first 145 and second 147 input shafts are depicted which lead into the gear box 140 from the first 110 and second 120 motors, respectively. Similarly, an output shaft 143 is depicted which leads to differential linkage 149 as described below. However, in between the inputs 145, 147 and the output 143, a ring gear 141 is positioned that is driven at a rate of rotation which is determined by the inputs 145, 147 as translated through pinions 142. It is this translation through the pinions 142 that allows for utilization of a comparative relationship between motor speeds to be determinative of output speed as described herein. For example, as depicted, the pinions 142 are coupled to the ring gear 141 and the first input 145 through side gears 146. The ring gear 141 is directly coupled to the pinions 142. Two examples of the differential action are instructive. In the first example, shaft 147 is rotating at the same speed and in the same direction as shaft 145. In this example, the pinions 142 do not rotate about their respective axles, but do impel the ring gear 141 around its axle. In turn, the ring gear 141 turns the pinion 144 and the output shaft 143. The speed of the output shaft 143 will be the speed of the input shafts 145, 147, multiplied by the ratio of the number of teeth on the ring gear 141 to the number of teeth on the pinion 144. In the drawing shown in FIG. 1B, the output shaft 143 will turn at approximately four times the speed of the input shafts 145, 147. In an example at the other extreme, when shafts 147 and 145 are driven at the same speed but in opposite directions, the pinions 142 are driven to rotate around their respective axles at roughly four times the speed of the input shafts 145 and 147. However, the ring gear 141 does not rotate because there is no difference in speed between the input shafts 145 and 147. For cases between these extreme examples, both the pinions 142 and the ring gear 141 rotate about their axles and produce an output speed related to the ratio of the respective speeds of the input shafts 145 and 147.

Continuing with reference to FIG. 1A, the differential gear box 140 is linked through the differential linkage 149 to the injector gear box 150. The injector gear box 150 translates the acquired differential rpm into an actual speed of rotation for injector chains 170, 180. Such translation may include a fairly dramatic speed reduction. So, for example, with added reference to FIGS. 2 and 3, an acquired 500 rpm differential speed may be translated into an injector chain rate of rotation corresponding to the injector 200 driving coiled tubing 310 into the well 385 at a rate of about 75 feet per minute. With more specific reference to FIGS. 1 and 2, the injector chains 170, 180 are configured to physically secure the coiled tubing 310 of FIG. 3 in the space 230 therebetween. Thus, the described driving rate of the chains 170, 180 determines the rate of advancement or withdrawal of the coiled tubing 310 from the well 385. In an embodiment, one or more brake or braking mechanism 121 may be incorporated between any one or more of the components, such as between the motor 110 and the differential gear box 140 or between the differential gear box 140 and injector gear box 150, best seen in FIG. 1A. The brake may comprise any suitable brake such as a friction brake or the like. In an embodiment, the brake or braking mechanism(s) 121 may act directly on the shaft or shafts 145 or 147. The brake or braking mechanism(s) 121 may be advantageously utilized on the individual linkages 115, 125 and before the gear boxes 140 and 150.

In the schematic of FIG. 1A, this chain rotation rate is independently relayed to each chain 170, 180 through first 155 and second 157 chain linkages. Indeed, with more specific reference to FIG. 2, chain rotation is driven by sprockets 240, 245 which are turned by the linkages 155, 157 of FIG. 1A. Additionally, while the chains 170, 180 are independently rotated, it is worth noting that they are nevertheless synchronized when in operation. That is, with the coiled tubing 310 of FIG. 3 physically squeezed and secured by the chains 170, 180 in concert, the rotation of the separate chains 170, 180 is maintained at a single uniform rate.

Referring now to FIG. 2, a partially sectional view of a coiled tubing injector 200 is depicted. The injector 200 makes use of the electrical multi-motor assembly 100 described above. In contrast to the schematic version depicted in FIG. 1A, the assembly 100 is depicted with housed electric motors 110, 120 positioned adjacently below similarly housed differential 140 and injector 150 gear boxes. Indeed, for ease of explanation and comparison with the schematic of FIG. 1A, the assembly 100 is shown oriented in this manner. However, in other embodiments it may be more preferable for the assembly 100 to be positioned at the top of the injector 200 (as opposed to the bottom) or it may be configured to drive any one or more of the chain sprockets. Of course, in alternate embodiments, a variety of other feature orientations may also be employed. Regardless, together these features of the assembly 100 serve to drive sprockets 240, 245, which in turn drive chains 170, 180, of the injector 200. Thus, coiled tubing 310 may be driven from a gooseneck guide 275 of the injector 200, past the assembly 100 and into a well 385 therebelow (see FIG. 3).

Figure 3:
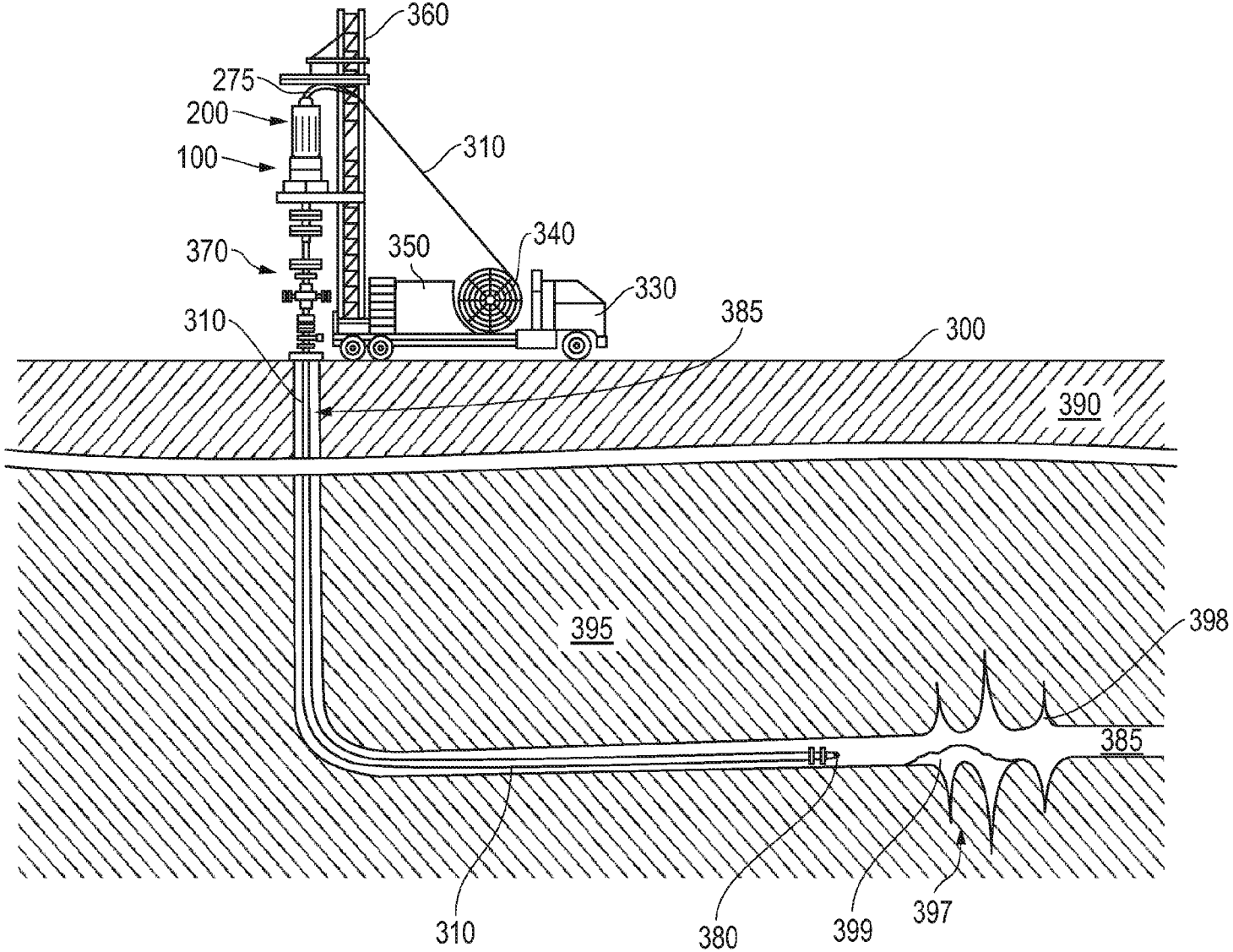
FIG. 3 is an overview of an oilfield with a well accommodating coiled tubing driven therethrough by the injector of FIG. 2.

Continuing with reference to FIG. 2, with added reference to FIG. 3, the injector 200 is described in greater detail. Namely, a gooseneck guide 275 is provided as described above for guiding coiled tubing 310 from a reel 340 at the oilfield 300 as depicted in FIG. 3. Support structure 277, mounted to the body of the injector 200, is provided for the gooseneck guide 275. More specifically, this structure 277 is mounted to the body of a straightening mechanism 250 with straightening channel 260 therethrough. Thus, as coiled tubing 310 is pulled through the mechanism 250 it is plastically reformed from a residually curved state, as a result of storage on the reel 340, into a straightened form for advancement into the well 385.

The above described straightening may be achieved by the mechanism 250 through application of a host of different conventional techniques. For example, in one embodiment, the channel 260 of the mechanism 250 is defined by rollers which may impart forces sufficient to continuously 'reverse kink' the advancing coiled tubing 310 into a straightened form as described.

Upon exiting the straightening channel 260, the tubing 310 may be forced between the chains 170, 180 as described above. The chains 170, 180 are positioned and shaped to firmly grasp the tubing 310 in a manner that avoids deformation thereof. As such, rotation of the sprockets 240, 245 as described above, serve to forcibly push the tubing 310 into the well 385 of FIG. 3. Indeed, as described above, the tubing 310 may be advanced in this manner at a variety of speeds without damage to the underlying electrical power assembly 100. For example, upon initial advancement into the well 385 of FIG. 3, the coiled tubing 310 may be advanced at rates of over 150 feet per minute. Alternatively, the coiled tubing 310 may be advanced at no more than about an inch per minute as it approaches a target location such as the debris 399 depicted in FIG. 3. Nevertheless, due to the multi-motor 110, 120 differential gear box 140 configuration and techniques detailed above, cooling issues with the assembly 100 are largely avoided.

Referring specifically now to FIG. 3, an overview of an oilfield 300 is shown. A well 385 traversing various formation layers 390, 395 is accommodated at the oilfield 300. The well 385 includes a horizontal section with a production region 397 having perforations 398 that are partially occluded by debris 399 such as sand. Thus, a clean-out application may be performed by advancement of coiled tubing 310 to the location of the debris 399 as described above. Other applications or operations may be performed in the well by the coiled tubing 310, such as, but not limited to, a well treatment operation, a fracturing operation, a milling operation, a scale removal operation, a perforating operation, a cementing operation such as cement squeezing, a cleanout operation, and a mechanical operation such as shifting sleeves, setting or removing plugs, and the like, as will be appreciated by those skilled in the art. A coiled tubing application directed by an injector 200 as described above, may be particularly adept at traversing the deviated well 385 and directing a hydraulic clean-out of the debris 399. Indeed, a clean-out nozzle 380 is provided at the end of the coiled tubing 310 for directing a high pressure clean-out fluid at the debris 399.

Continuing with reference to FIG. 3, the coiled tubing 310 is delivered to the well site by way of a coiled tubing truck 330. The truck 330 accommodates a reel 340 of the tubing 310, a control unit 350, and a rig 360. Thus, most of the surface equipment for the clean-out application is provided in a fairly mobile manner. The application may even be directed from the control unit 350 at the truck 330. Once more, the mobile rig 360 provides support for the injector 200 as described above. In fact, due in part to the smaller footprint and less cumbersome nature of the electric multi-motor assembly 100, all of the driving equipment, from the gooseneck guide 275 to just above the 'Christmas tree' 370, may be accommodated at the rig 360.

Once traversing the indicated injector 200 and assembly 100, the coiled tubing may be directed through the noted 'Christmas tree' 370, including blowout preventor and other pressure control and valve equipment. Thus, integrity of the well 385 is maintained as the coiled tubing 310 is driven therethrough. Further, while this access to the well 385 is achieved via coiled tubing 310, it is worth noting that other types of well access line may be driven by a multi-motor assembly 100 as described herein. For example, drill pipe, capillary tubing and wireline cable may be delivered, retrieved, or otherwise positioned in a well 385 with an embodiment of an electric multi-motor assembly 100 as described herein.

Figure 4A:
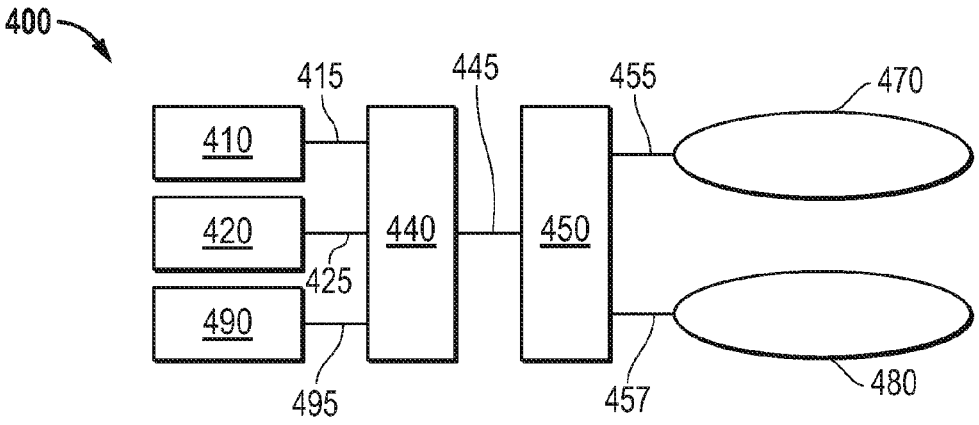
FIG. 4A is a schematic representation of an alternate embodiment of an electrically driven coiled tubing assembly employing more than two motors.
Figure 4B:
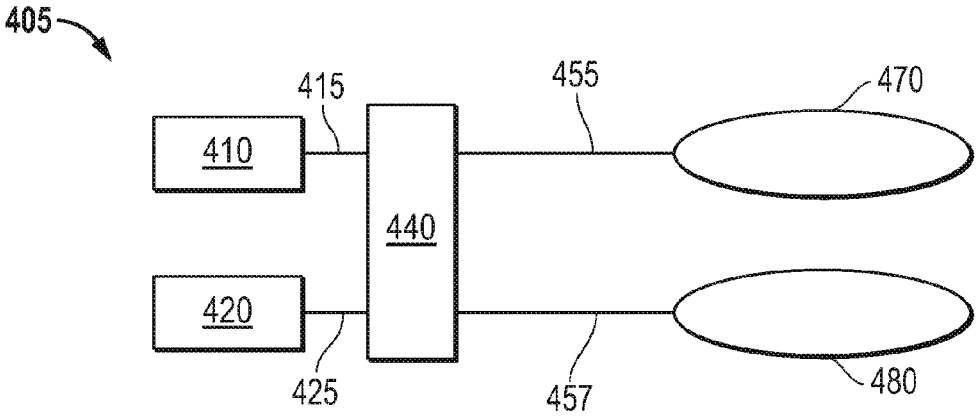
FIG. 4B is a schematic representation of an alternate embodiment of the assembly employing a differential gear box with speed reduction.
Figure 4C:
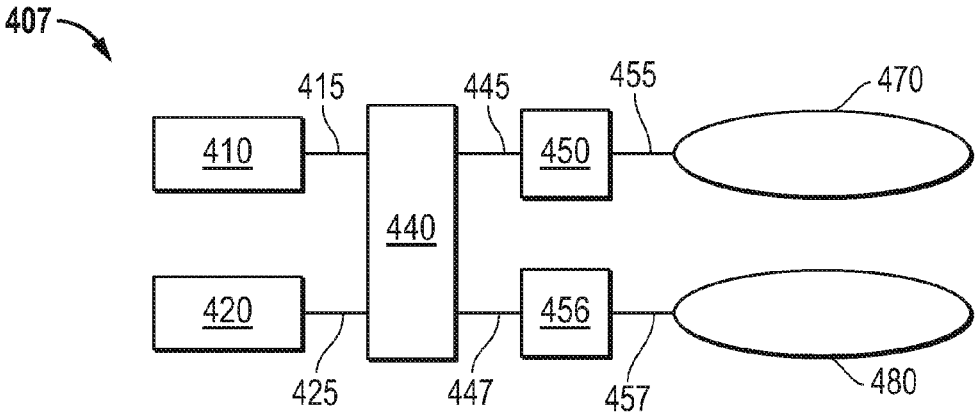
FIG. 4C is a schematic representation of an alternate embodiment of the assembly employing multiple speed reducers.

Referring now to FIGS. 4A-4C, schematic views of alternate configurations of electric multi-motor assemblies 400, 405, 407 are depicted. More specifically, with reference to FIG. 4A, a representation of an electrically driven assembly 100 is shown which utilizes more than two electric motors 410, 420, 490. Nevertheless, as in the case of the embodiment of FIG. 1A, a differential gear box 440 is provided which is coupled to the various motors 410, 420, 490 through appropriate linkages 415, 425, 495. This gear box 440 is again configured to govern over a comparative relationship between speeds of the various motors 410, 420, 490 as described below.

In one embodiment, one of the motors 410 of FIG. 4A may be comparatively large and configured to operate at particularly high speeds, in terms of maintaining proper cooling. Alternatively, the other motors 420, 490 may be smaller and operate at generally lower speeds in maintaining adequate cooling. Regardless, the relationship between the motors 410, 420, 490 as governed by the differential gear box 440 may be such that the speeds of the slower motors 420, 490 are both subtracted from that of the faster motor 410. Thus, similar to the embodiment of FIG. 1A, an entire range of speeds, now even up to the increased speed of the larger motor 410, may be available to the system. More specifically, this now larger range of speeds is available for translating across the injector linkage 445 to the injector gear box 450 and ultimately the depicted chains 470, 480 (through chain linkages 455, 457).

The inclusion of more than two motors 410, 420, 490 as shown in FIG. 4A adds a degree of redundancy to the assembly 400. Thus, breakdown of one of the electric motors 410, through overheating or otherwise, is less likely to lead to breakdown of the other motors 420, 490. Indeed, with multiple other motors 420, 490 still available, their operating at safe cooling speeds without significant sacrifice to variable speed capacity of the chains 470, 480 remains practical.

Referring now to FIG. 4B, an alternate schematic is depicted in which the assembly 405 utilizes a combination differential injector gear box 440. So, for example, where straight line speed reduction between the gear box 440 and the chains 470, 480 is not sought, it may be possible to more directly translate the differential rpm. That is, while speed reduction may be foregone, the lack of a separate injector gear box does not sacrifice variable speed capacity of the assembly 405 as detailed herein.

As opposed to the avoidance of speed reduction as depicted in FIG. 4B, FIG. 4C reveals a schematic representation of the assembly 407 where multiple speed reducing injector gear boxes 450, 456. That is, an injector gear box 450, 456 for each chain 470, 480 is independently linked to the differential gear box 440 through appropriate injector linkages 445, 447. As a result, speed reduction is independently translated to each chain 470, 480. This type of redundancy may improve the reliability of the assembly 407 in terms of speed of operation. For example, should one of the injector gear boxes 450 become ineffective, synchronization of the chains 470, 480 may be maintained through coiled tubing or other line therebetween. Thus, the speed of the chains 470, 480 may remain stable even though speed reduction is directly applied to only one of the chains 480 through the remaining functional gear box 456.

Figure 5:
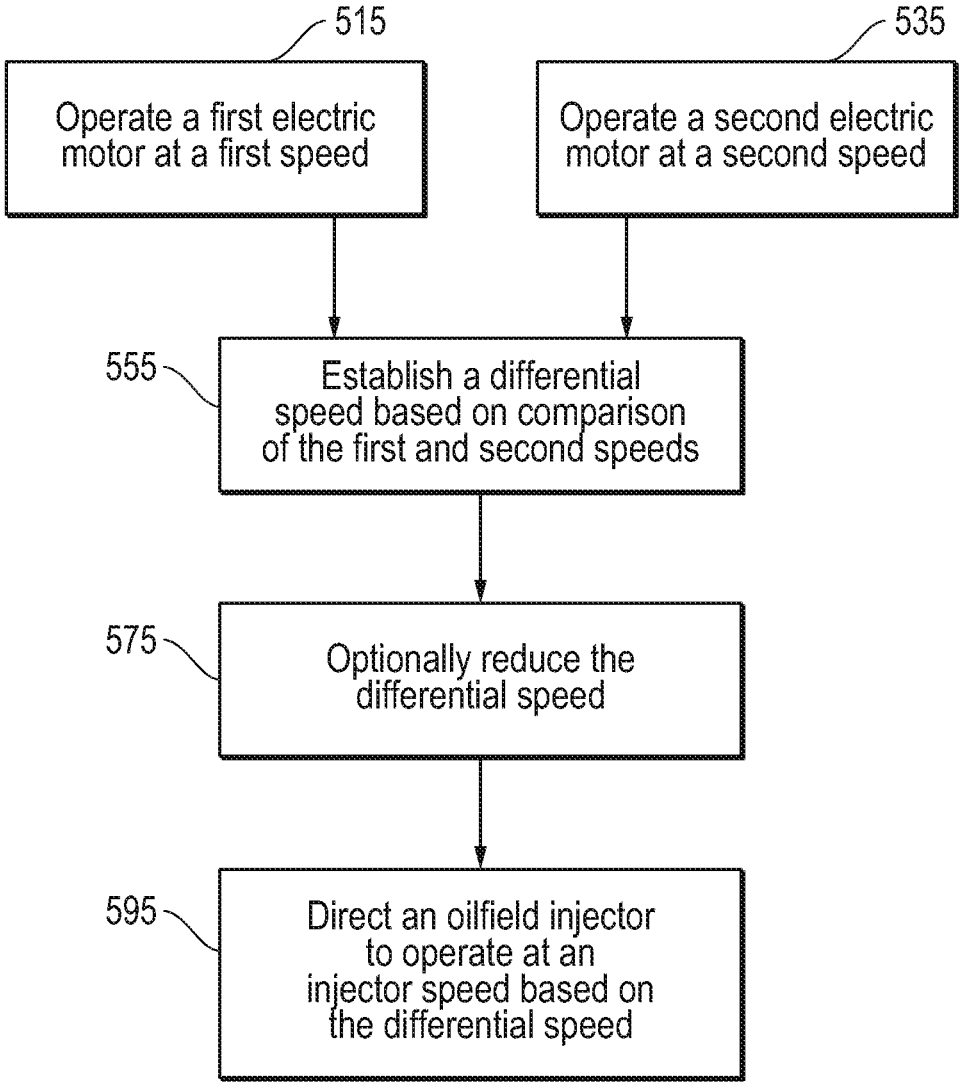
FIG. 5 is a flow-chart summarizing an embodiment of employing a multi-motor electrically driven coiled tubing assembly.

Referring now to FIG. 5 a flow-chart summarizing an embodiment of employing a multi-motor electrically driven injector assembly is depicted. Namely, separate electric motors may be independently operated at their own speeds as indicated at 515 and 535. As detailed above, these speeds may be sufficient to ensure adequate cooling is available to the motors during operation.

In spite of the multiple, generally high speed operation of the motors, however, a differential speed is established as indicated at 555. The differential speed is based at least in part on comparison of the different motor speeds. Thus, a different, generally much lower, rpm than that of the motor speeds may be available. Indeed, an entire range of speeds may be available for use. Nevertheless, as indicated at 575, a linear reduction in speed may still be sought where appropriate. Regardless, an injector speed is ultimately acquired and utilized that is based on the differential speed and available for driving an application such as the above described coiled tubing clean-out. In an embodiment, the rotation of one of the motors, such as motors 110, 120 may be stopped while the other of the motors 110, 120 may continue rotating, wherein the operation of the assembly 100 may be maintained. Such a configuration may be advantageous, for example, in the event of the failure of one of the motors 110, 120.

Embodiments described herein provide equipment and techniques which allow for the effective utilization of electric motors for driving oilfield injector applications. That is, in spite of high torque requirements, low speed injection may be available without sacrifice to cooling requirements of the motors. Indeed, through techniques detailed herein, an entire variable range of injection speeds is made available. Furthermore, this is achieved without the introduction of liquid coolant or external cooling devices. Thus, electric motor benefits of reduced size and footprint at the oilfield may be maintained.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

I claim:

1. A method of running an oilfield injector assembly, the method comprising:

operating a first electric motor at a first motor speed;

operating at least a second electric motor at a second motor speed;

linking a differential gear box to the first electric motor and the second electric motor;

establishing a differential speed based at least in part on comparison of the first and second speeds;

linking a plurality of injector chains to the differential gear box through an injector gear box linked directly to the plurality of injector chains; and directing the plurality of injector chains of the oilfield injector to operate at a synchronized injector speed established based on the differential speed;

the differential speed being reduced prior to said directing by the injector gear box.

2. The method of claim 1 further comprising positioning a well access line in a well aligned with the injector.

3. The method of claim 2 further comprising performing an application in the well with the line.

4. The method of claim 2 wherein said positioning takes place at a speed of between about an inch per minute and about 150 feet per minute.

5. The method of claim 2 wherein said positioning further comprises:

initially moving the line in the well at a first injector speed; and subsequently moving the line in the well at a second injector speed substantially different from the first injector speed.

6. The method of claim 2 wherein said positioning comprises one of advancing and withdrawing the line relative the well.

7. The method of claim 6 wherein the comparison is the net of the first speed less a percentage of the second speed.

8. The method of claim 7 wherein the percentage is 100 percent.

9. The method of claim 8 wherein the first speed is greater than the second speed such that the net is positive for said positioning to include the advancing.

10. The method of claim 8 wherein the second speed is greater than the first speed such that the net is negative for said positioning to include the withdrawing.

11. A coiled tubing injector comprising:

at least two motors configured to operate at different speeds;

a differential mechanism coupled to all of said motors and configured to establish a differential speed based at least in part on comparison of the different speeds, a rate of coiled tubing movement based on the differential speed;

at least two injector chains linked to the differential mechanism for engaging with and driving the coiled tubing into a well; and a speed reducing injector mechanism coupled to said differential mechanism and directly to each of the at least two injector chains to reduce the differential speed in establishing the rate, the injector chains synchronized when in operation by the differential mechanism and the speed reducing injector mechanism.

12. The coiled tubing injector of claim 11 wherein each of said motors is electric.

13. An oilfield injector assembly for positioning a well access line in a well, the assembly comprising:

a first electric motor configured to operate at a given speed;

at least a second electric motor configured to operate at a different speed, wherein the given and different speeds are substantially adequate air cooling speed for said electric motors;

a differential gear box coupled to all of said motors and configured to establish a differential speed based at least in part on comparison of the given and different speeds, the differential speed determinative of an injector speed at which the well access line is positioned in the well; and a plurality of injector chains coupled to the differential gear box for engaging with and driving the well access line into the well, each of the injector chains moving the well access line at the injector speed; and at least one speed reducing injector gear box coupled to said differential gear box and directly coupled to the plurality of injector chains for reducing the differential speed in establishing the injector speed.

14. The assembly of claim 13 wherein the oilfield injector is configured to position one of coiled tubing, drill pipe, capillary tubing, and a wireline cable.

15. The assembly of claim 13 further comprising at least one braking mechanism disposed between the differential mechanism and at least one of the first electric motor and the second electric motor.

16. The assembly of claim 13 further comprising another motor coupled to said different gear box.

17. A method of running an oilfield injector assembly, the method comprising:

operating a first motor at a first motor speed;

operating a second motor at a second motor speed;

linking a differential gear box to the first motor and the second motor;

linking the differential gear box to an injector gear box via a differential linkage;

linking the injector gear box directly to a plurality of injector chains;

establishing a differential output speed based at least in part on comparison of the first and second speeds; and synchronizing the operation of the injector chains by directing an oilfield injector to operate at an injector speed established based on the differential output speed, the injector gear box configured to reduce the differential speed to the injector speed.

18. The method of claim 17 wherein the first and second motors are electric motors.

19. The method of claim 17 further comprising ceasing said operating of a one of the first motor and the second motor, said directing continuing.

20. The method of claim 17 further comprising operating at least a third motor at a third motor speed, wherein employing comprises employing a differential mechanism to establish a differential speed based at least in part on comparison of the first, second, and third motor speeds.

* * * * *